US009682469B2

(12) United States Patent
Heise

(10) Patent No.: US 9,682,469 B2
(45) Date of Patent: Jun. 20, 2017

(54) MULTIPURPOSE TOOL

(71) Applicant: Leatherman Tool Group, Inc., Portland, OR (US)

(72) Inventor: Zach Heise, Portland, OR (US)

(73) Assignee: Leatherman Tool Group, Inc., Portland, OR (US)

( * ) Notice: Subject to any disclaimer, the term of this patent is extended or adjusted under 35 U.S.C. 154(b) by 314 days.

(21) Appl. No.: 14/577,666

(22) Filed: Dec. 19, 2014

(65) Prior Publication Data

US 2016/0176035 A1 Jun. 23, 2016

(51) Int. Cl.

| | |
|---|---|
| ***B25F 1/00*** | (2006.01) |
| ***B25F 1/04*** | (2006.01) |
| ***B26B 11/00*** | (2006.01) |
| ***F23Q 1/06*** | (2006.01) |

(52) U.S. Cl.

CPC ..... *B25F 1/003* (2013.01); *B25F 1/04* (2013.01); *B26B 11/003* (2013.01); *F23Q 1/06* (2013.01)

(58) Field of Classification Search

CPC ..... B25F 1/003; B25F 1/04; B26B 11/003; F23Q 1/06

See application file for complete search history.

(56) References Cited

U.S. PATENT DOCUMENTS 5,251,353 A 10/1993 Lin
7,185,569 B2 * 3/2007 Knight ..... B25B 15/001 7/165
7,347,128 B2 * 3/2008 Rivera ..... B25B 15/001 30/152
7,568,408 B2 8/2009 Tsuda
7,634,956 B2 * 12/2009 Rivera ..... B25F 1/003 7/118
8,166,850 B2 5/2012 Caniparoli et al.

(Continued)

FOREIGN PATENT DOCUMENTS

EP 1679159 A2 7/2006
WO WO-2014/117206 A1 8/2014

OTHER PUBLICATIONS

European Office Action for European Patent Application No. 15003496.5 dated Jul. 22, 2016, 2 pages.

(Continued)

*Primary Examiner* — David B Thomas
(74) *Attorney, Agent, or Firm* — Alston & Bird LLP

(57) ABSTRACT

A multipurpose tool is provided which may be useful for functions relating to survival. The multipurpose tool may include a variety of tools and features while maintaining a compact form. For example, the multipurpose tool may include a first handle and a second handle configured for relative movement between a closed position and an open position. The first handle may define a cavity that is accessible in response to the first handle and second handle being disposed in the open position relative to one another, and inaccessible in response to the first handle and second handle being disposed in the closed position relative to one another. A removable component may be disposed, at least partially, within the cavity of the first handle, where the removable component is accessible in response to the first handle and the second handle being disposed in the open position relative to one another.

18 Claims, 17 Drawing Sheets

(56) References Cited

U.S. PATENT DOCUMENTS

| | | | | |
|---|---|---|---|---|
| 9,138,881 | B2 * | 9/2015 | Caniparoli | B25F 1/003 7/128 |
| 2001/0037528 | A1 | 11/2001 | Ackeret | |
| 2006/0262518 | A1 | 11/2006 | Thuma et al. | |
| 2007/0131069 | A1 | 6/2007 | Rivera et al. | |
| 2009/0000038 | A1 | 1/2009 | Padden | |
| 2014/0127984 | A1 * | 5/2014 | Smith | B25F 1/00 451/461 |

OTHER PUBLICATIONS

Notice of Acceptance for Australian Patent Application No. 2015255323 dated Oct. 14, 2016, 2 pages.
Extended European Search Report for European Patent Application No. 15003496.5 dated Nov. 15, 2016, 10 pages.
Patent Examination Report for Australian Patent Application No. 2015255323 dated Jul. 5, 2016.

* cited by examiner

MULTIPURPOSE TOOL

FIELD

Embodiments of the present invention relate generally to a multipurpose tool and, more particularly, to a multipurpose tool configured to provide additional features including, in one example, features configured for wilderness survival.

BACKGROUND

Multipurpose tools are widely popular for their utility in a substantial number of different applications. As its name suggests, a multipurpose tool includes a number of tools carried by a common frame. A multipurpose tool may include different combinations of tools depending upon its intended application. For example, multipurpose tools that are designed for a more universal or generic application can include pliers, a wire cutter, a bit driver, one or more knife blades, a saw blade, a bottle opener or the like. Other multipurpose tools are designed to service more specific applications or niche markets and correspondingly include tools that are useful for the intended application. For example, multipurpose tools may be specifically designed for automobile repairs, hunting, fishing or other outdoor applications, gardening and the like.

One reason for the popularity of multipurpose tools is the capability provided by a multipurpose tool to provide a wide range of functionality with a single tool, thereby reducing the need to carry a number of different tools to perform those same functions. For example, a single multipurpose tool may be carried instead of a pair of pliers, one or more screwdrivers, a knife and a bottle opener. As such, the burden upon a user is reduced since the user need only carry a single multipurpose tool.

As multipurpose tools are frequently carried by users in the field, it is desirable for the multipurpose tools to be relatively small and lightweight while remaining rugged so as to resist damage. In order to reduce the overall size of a multipurpose tool, some multipurpose tools have been designed to be foldable. In this regard, foldable multipurpose tools are designed to move between a closed position and an open position. Generally, the closed position is more compact with the multipurpose tool frequently being carried in the closed position. Conversely, while the open position is generally less compact than the closed position, the open position generally allows the deployment of one or more of the tools that are stowed and relatively inaccessible when the multipurpose tool is in the closed position.

For example, a multipurpose tool may include pliers having a pair of jaws connected to respective handles. In the open position, the pliers are deployed and capable of being actuated by movement of the handles toward and away from one another. In the closed position, the handles may be folded about the pliers such that the pliers are no longer functional. In the closed position, however, the multipurpose tool is more compact with the form factor generally defined by the proximal relationship of the handles.

However, it may be desirable for the multipurpose tool to include additional functionality. As such, the present applicant has designed a multipurpose tool having a compact configuration, even in instances in which the multipurpose tool includes additional functionality.

BRIEF SUMMARY

Embodiments of the present invention relate generally to a multipurpose tool and, more particularly, to a multipurpose tool configured to provide additional features including, in one example, features configured for wilderness survival. According to one embodiment, a multipurpose tool is provided. The multipurpose tool may include a first handle and a second handle configured for relative movement between a closed position and an open position. The first handle may define a cavity that is accessible in response to the first handle and second handle being disposed in the open position relative to one another, and inaccessible in response to the first handle and second handle being disposed in the closed position relative to one another. A removable component may be disposed, at least partially, within the cavity of the first handle, where the removable component is accessible in response to the first handle and the second handle being disposed in the open position relative to one another. Embodiments may include a retention element disposed within the cavity configured for relative movement within the cavity between a capture position and a release position, where the retention element is biased in the capture position. The retention element may be configured to retain the removable component within the cavity in response to the retention element being disposed in the capture position. The removable component may be removable from the cavity in response to the retention element being moved to the release position.

According to some embodiments, the removable component may be configured to drive the retention element from the capture position to the release position in response to the removable element being inserted into the cavity toward the capture position. The retention element may be configured to return to the capture position in response to the removable element being seated in the capture position within the cavity. The removable component may include a fire-starting element, such as a ferrocerium rod. The removable component may optionally include a whistle. Embodiments may include a first jaw of a pair of pliers attached to the first handle and a second jaw of the pair of pliers attached to the second handle, where the first jaw is hingedly attached to the second jaw. The first jaw and the second jaw of the pair of pliers may be disposed in a deployed position in response to the first handle and the second handle being disposed in the open position relative to one another, and the first jaw and the second jaw of the pair of pliers may be disposed in a stowed position in response to the first handle and the second handle being disposed in the closed position relative to one another.

According to some embodiments, the first jaw may be configured to be received within a cavity within the second handle and the second jaw may be configured to be received within the cavity of the first handle in response to the first handle and the second handle being disposed in the closed position relative to one another. Embodiments may include a second removable component, where the second removable component includes an abrasive surface. A multipurpose tool of some example embodiments may include a knife blade movable between a stowed position and a deployed position, where the knife blade is at least partially received within at least one of the first handle and the second handle in response to being disposed in the stowed position. The abrasive surface of a removable component may be configured to be used to sharpen the knife. The second removable component may optionally define a channel, while one of the first handle or the second handle may include a raised element configured to be received within the channel and to secure the second removable component to the at least one of the first handle or the second handle.

Embodiments of the present invention may provide a removable component for a multipurpose tool. The removable component may include a body, a fire-starting element received by the body, and a cavity defined by the body with at least one opening defined by the body in fluid communication with the cavity. At least a portion of the fire-starting element may be accessible from outside the body. The at least one opening and the cavity may cooperate to function as a whistle in response to air being forced through one of the at least one openings. The body may define a profile configured to securely engage a handle of a multipurpose tool. The body may further define a ramp configured to bias a retention element to a release position in response to the removable component being inserted into a cavity of the handle of the multipurpose tool.

Embodiments of the present invention may provide a multipurpose tool including a first handle and a second handle configured for relative movement between a closed position and an open position, a folding tool movable between a stowed position and a deployed position, and a removable component. The first handle may define a cavity that is accessible in response to the first handle and the second handle being disposed in the open position relative to one another, and inaccessible in response to the first handle and the second handle being disposed in the closed position relative to one another. The folding tool may be received within the first handle or the second handle in response to being disposed in the stowed position. The removable component may be received within the cavity and may include a fire-starting element configured for use with the folding tool when the removable component is removed from the cavity.

Example embodiments may include a retention element disposed within the cavity and movable between a capture position and a release position, where the retention element may be configured to retain the removable component within the cavity in response to the removable component being received within the cavity and the retention element being disposed in the capture position. The retention element may be biased toward the capture position. The removable component may be configured to drive the retention element from the capture position to the release position in response to the removable component being inserted into the cavity. The removable component may optionally include a whistle. The removable component may be a first removable component, and the multipurpose tool of example embodiments may include a second removable component, where the second removable component includes an abrasive surface. The fire-starting element of the removable component may include a ferrocerium rod.

Example embodiments may provide a multipurpose tool including a first handle and a second handle configured for relative movement between a closed position and an open position. The multipurpose tool may also include a folding tool movable between a stowed position and a deployed position, where the tool is received within the first handle or the second handle in response to being disposed in the stowed position. Embodiments may also include a removable component removably attached to the first handle, where one of the removable component or the first handle includes a raised rivet while the other of the removable component or the first handle includes a recess defining a first recess portion and a second recess portion. The rivet may be configured to be removably received within the first recess portion and moved, relative to the recess, to the second recess portion. The removable component may be secured to the first handle in response to the raised rivet engaging the second recess portion.

According to some embodiments, the rivet includes a shaft portion and a head portion, while the recess includes a neck portion defined between the first recess portion and the second recess portion. The neck portion of the recess may be narrower than a diameter of the shaft portion of the rivet. A diameter of the first recess portion may be equal to or greater than a diameter of the head portion of the rivet, and a diameter of the second recess portion may be smaller than the diameter of the head portion of the rivet. One of the first handle or the removable component includes an alignment feature while the other of the first handle and the removable component includes a cavity. The alignment feature may be configured to engage the cavity in response to the removable component being attached to the first handle. According to some embodiment, the first handle may include a lock release lever defining a raised, locked position and a depressed, release position, where the rivet is precluded from being moved from the second recess portion to the first recess portion in response to the lock release lever being in the raised, locked position.

BRIEF DESCRIPTION OF THE SEVERAL VIEWS OF THE DRAWINGS

Figure 1:
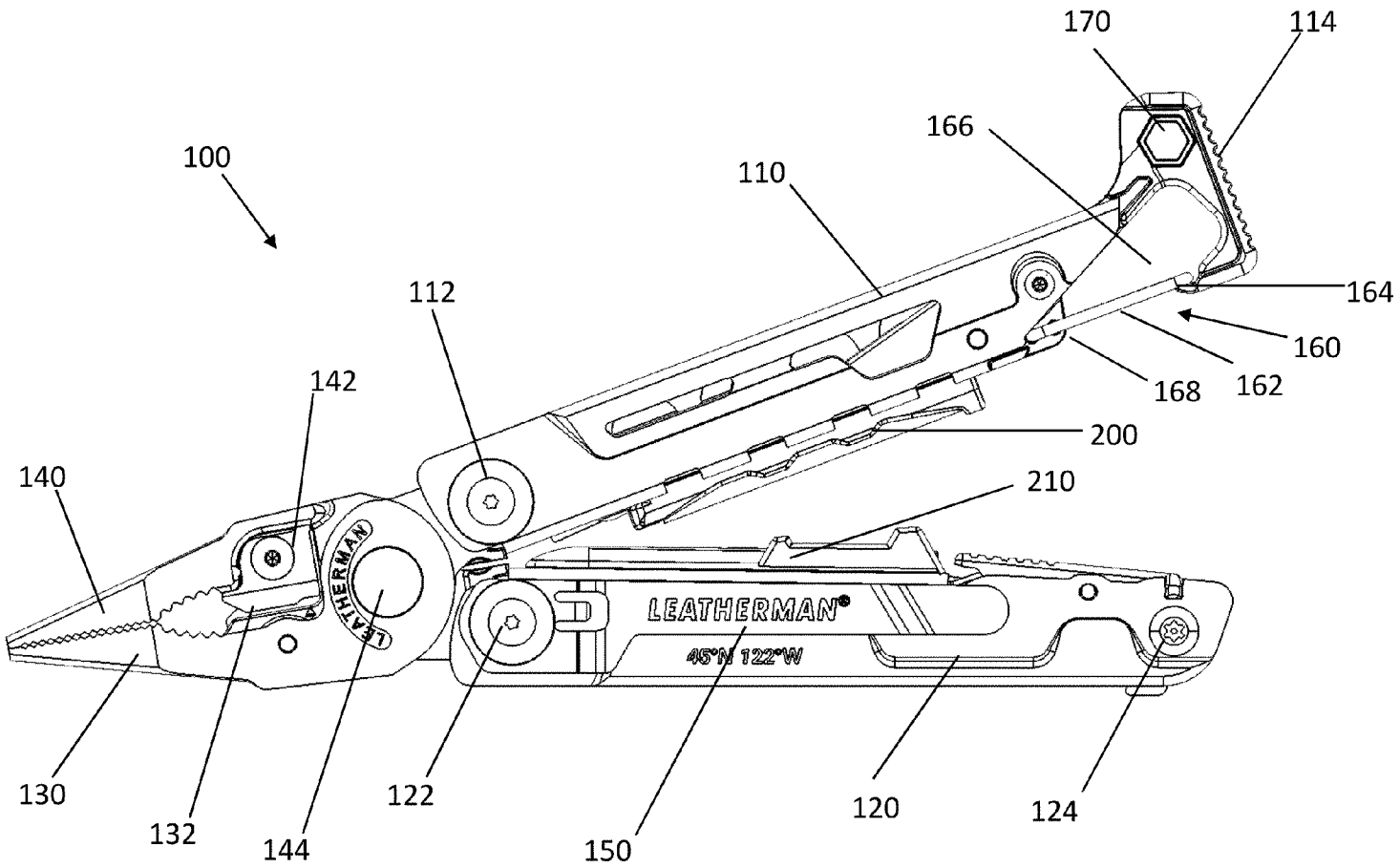
Figure 2:
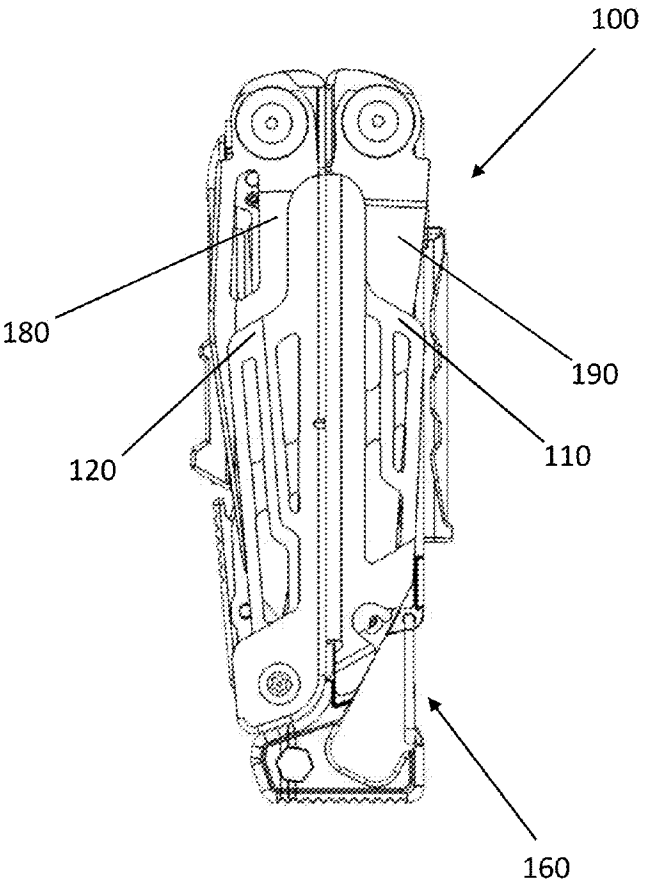
Figure 3:
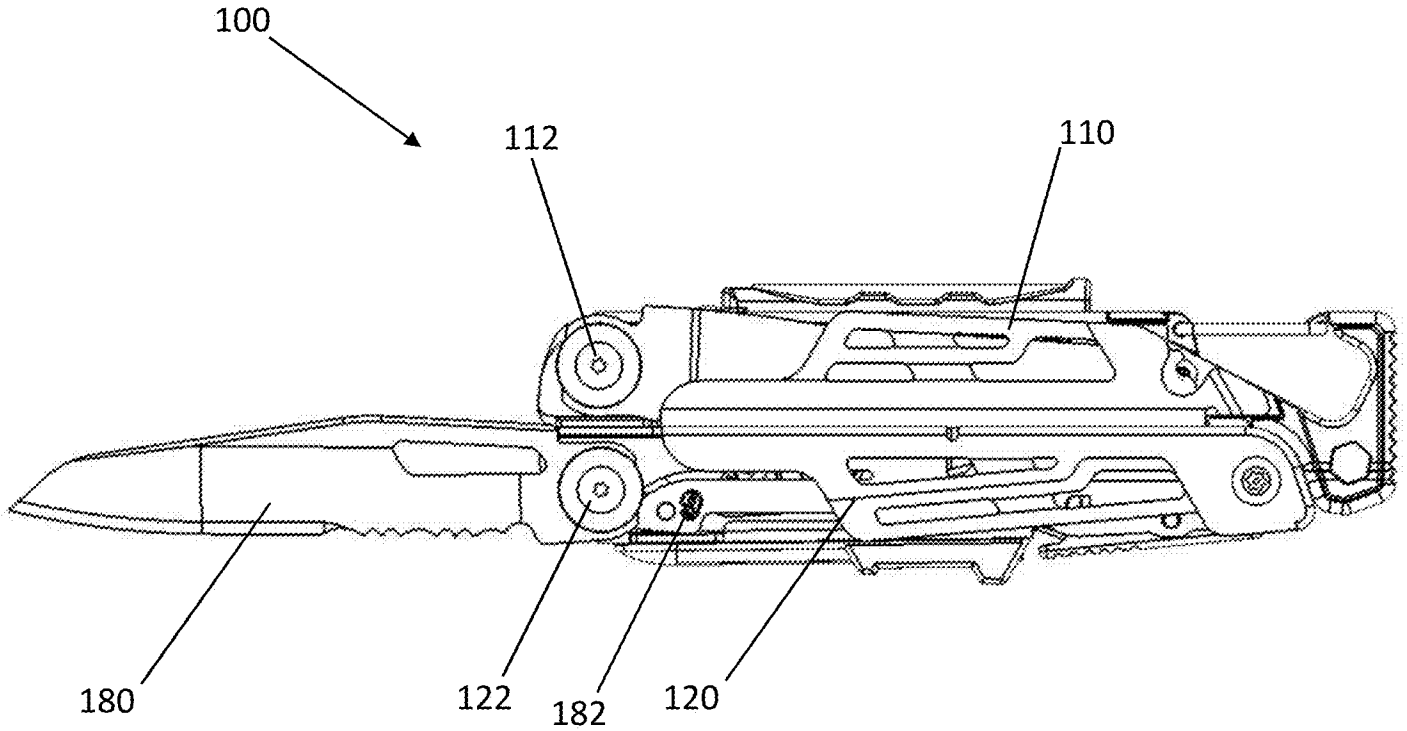
Figure 4:
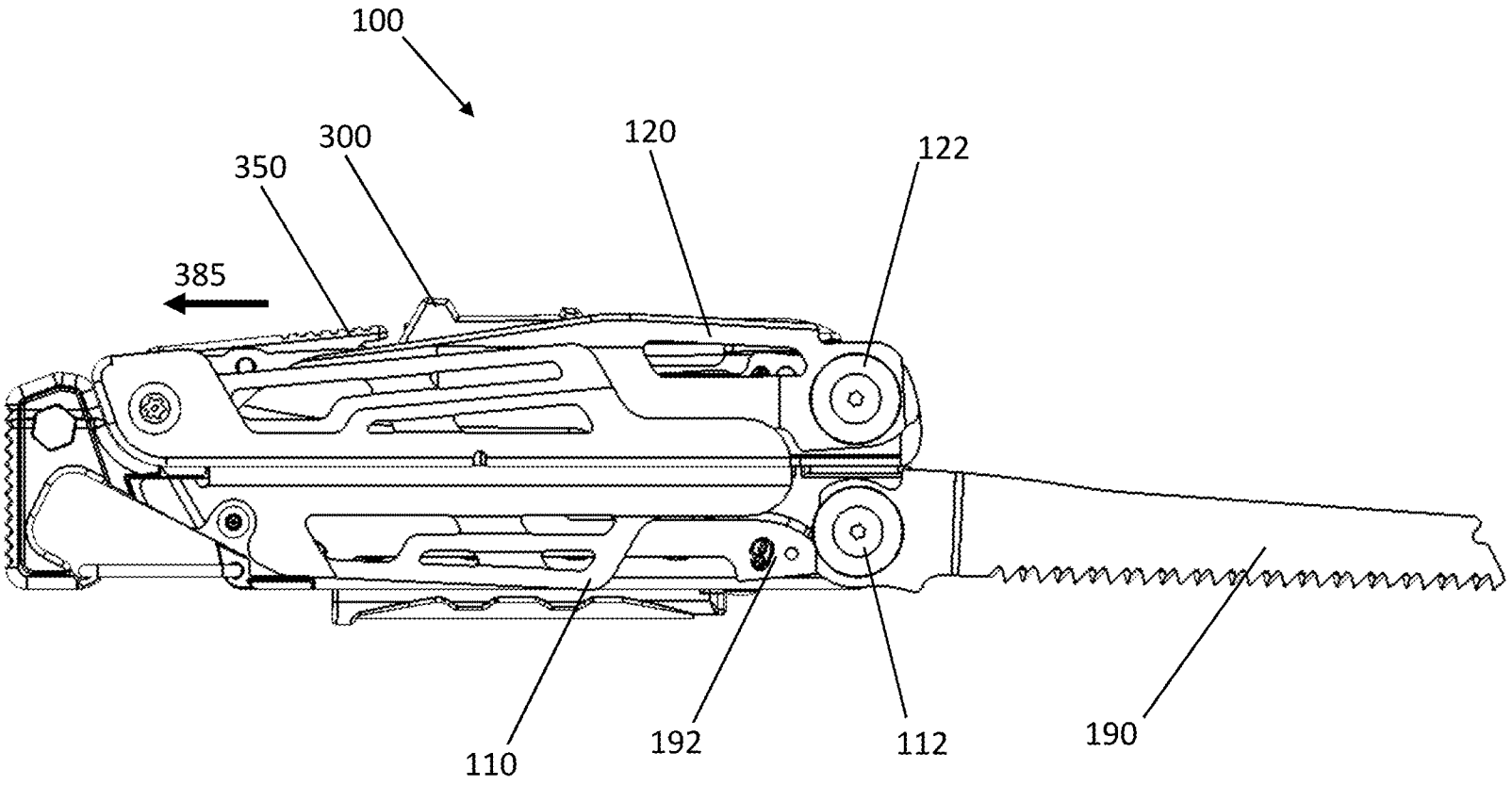
Figure 5:
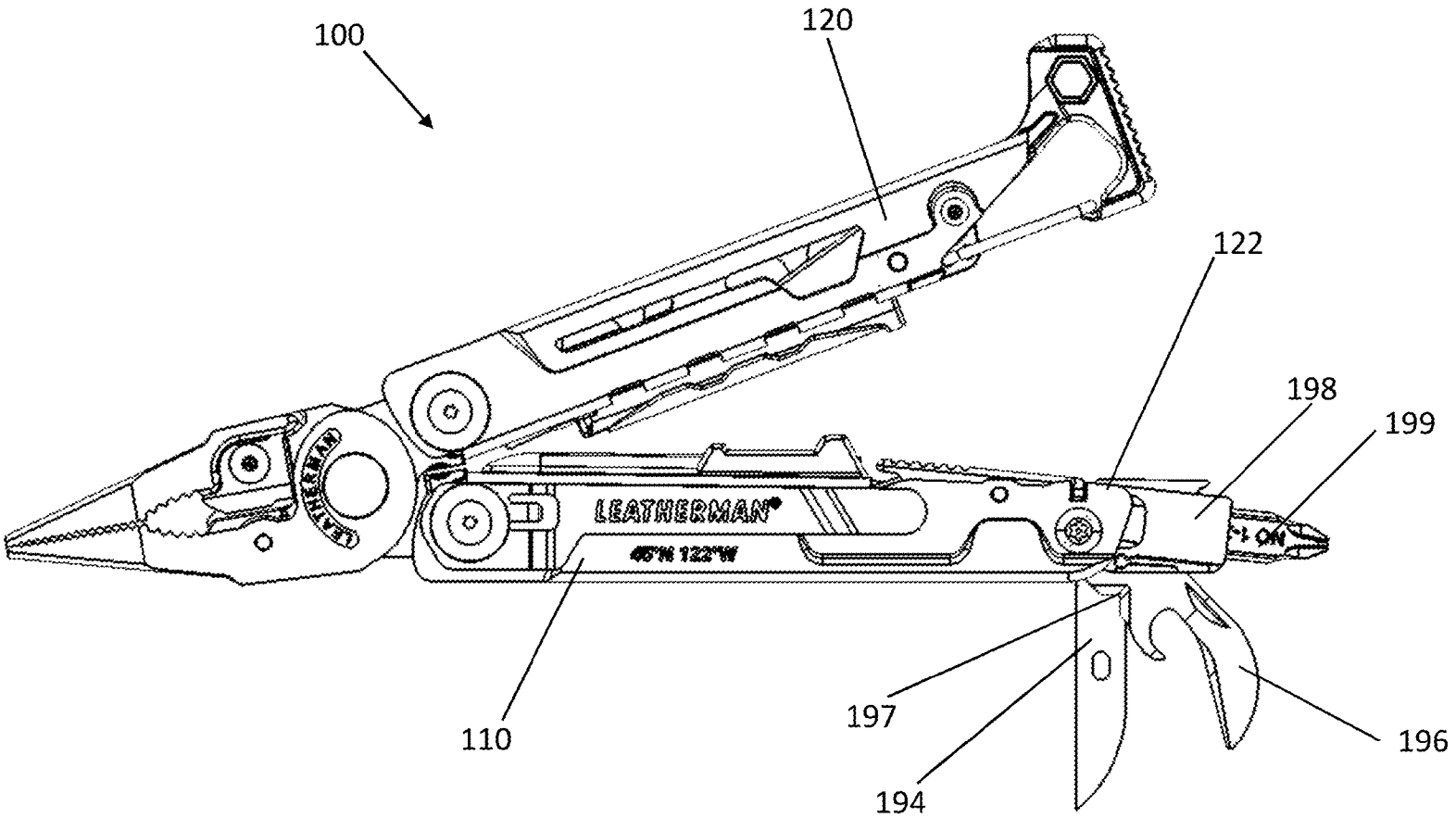
Figure 6:
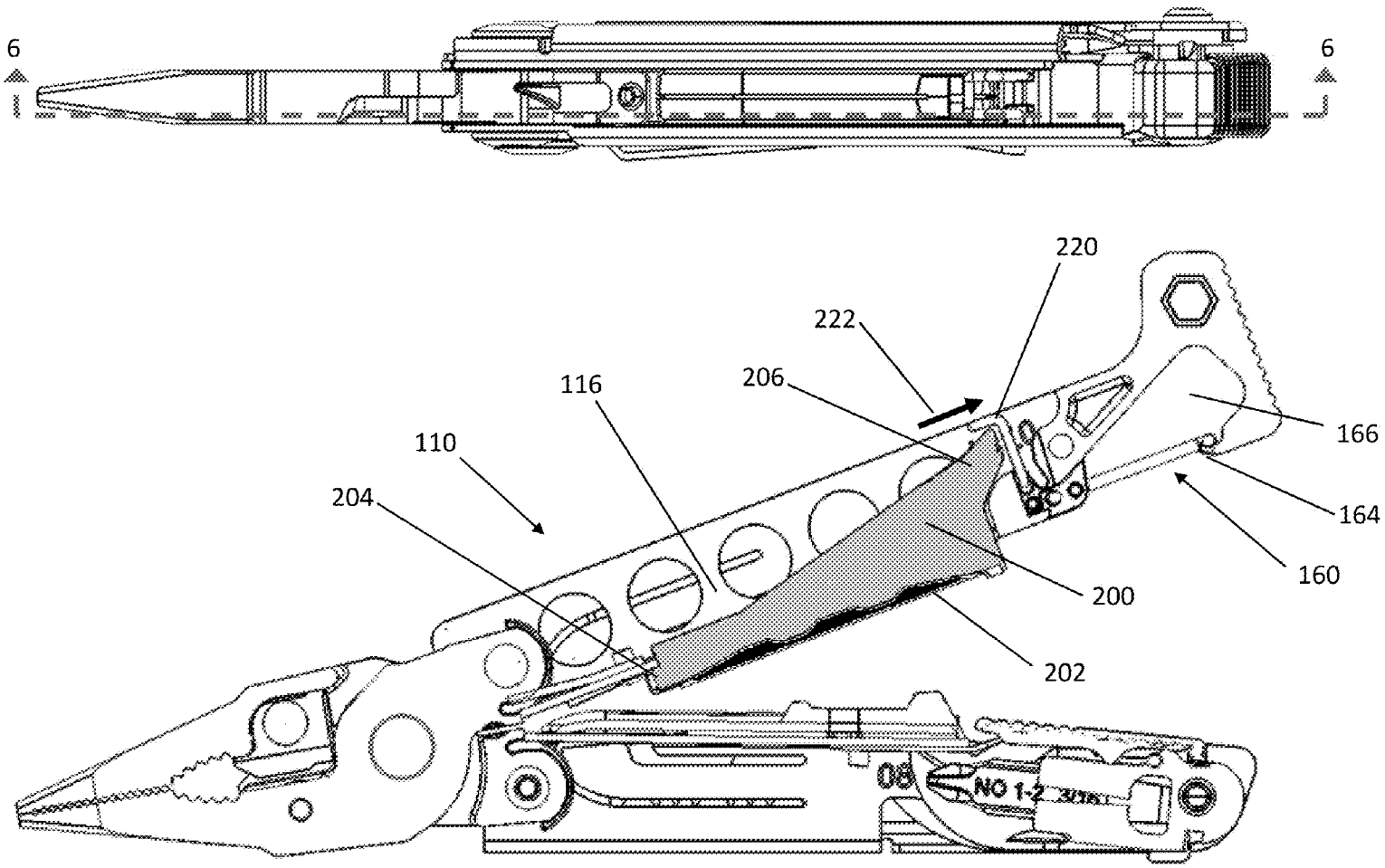
Figure 7:
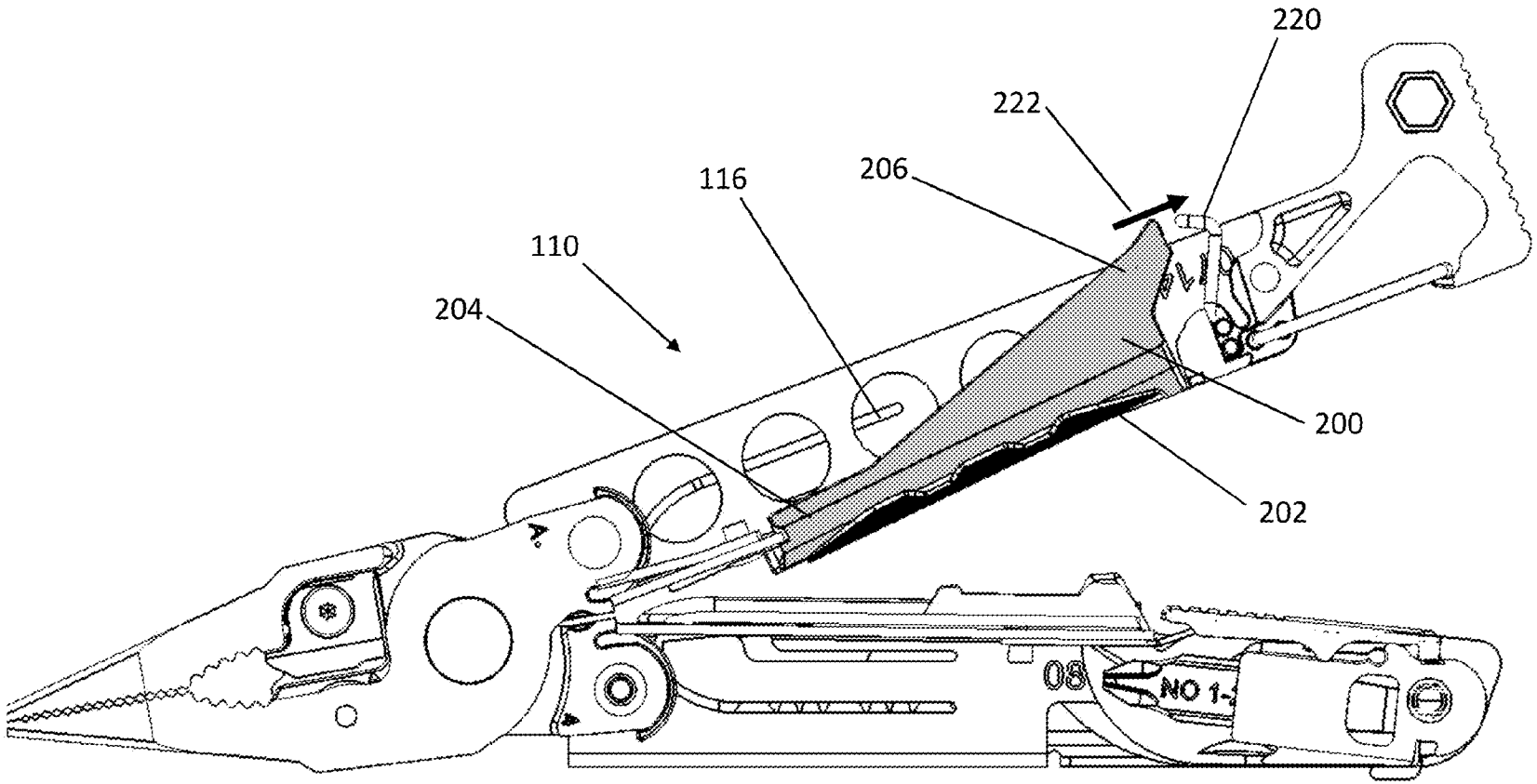
Figure 8:
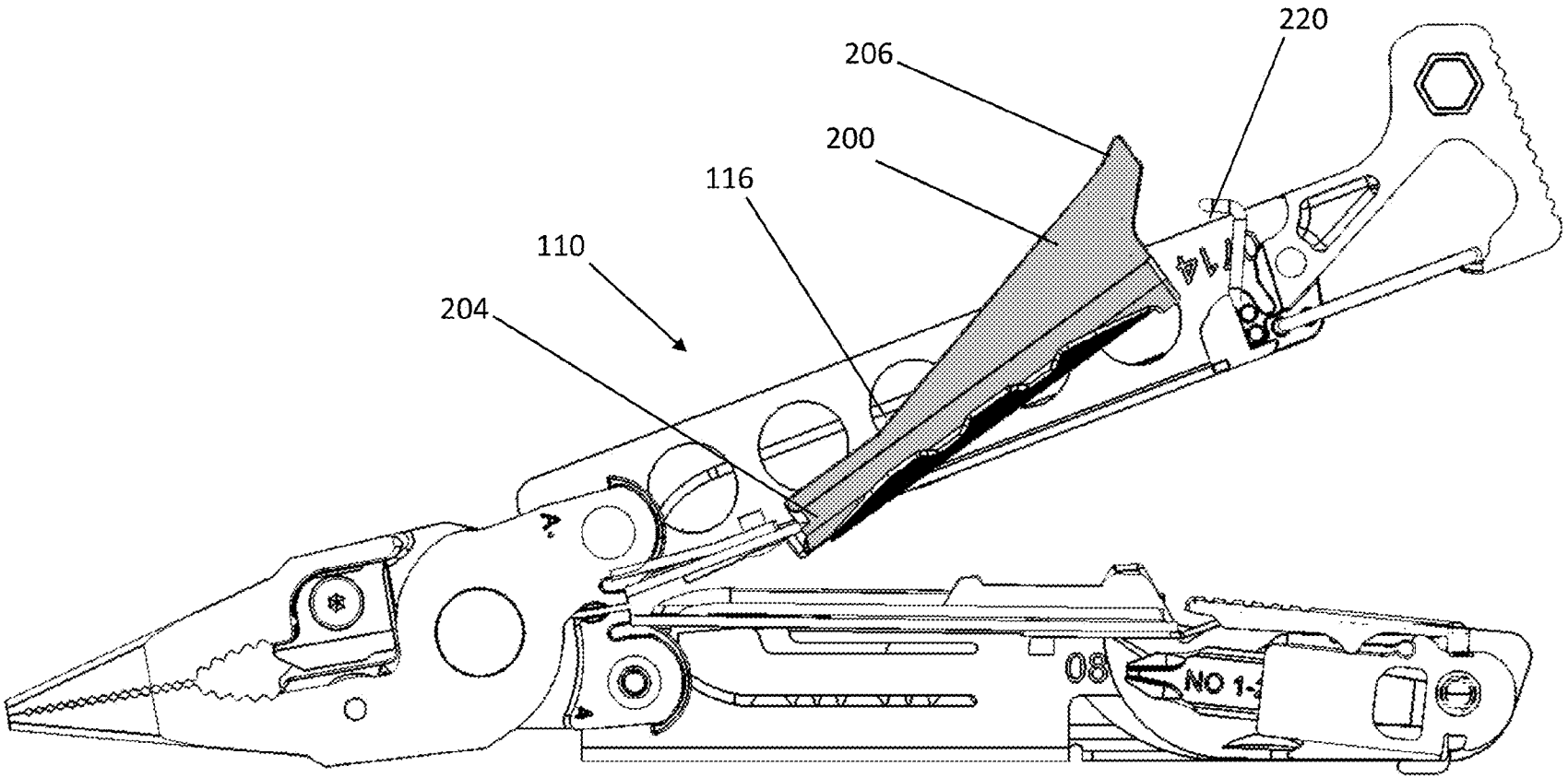
Figure 9:
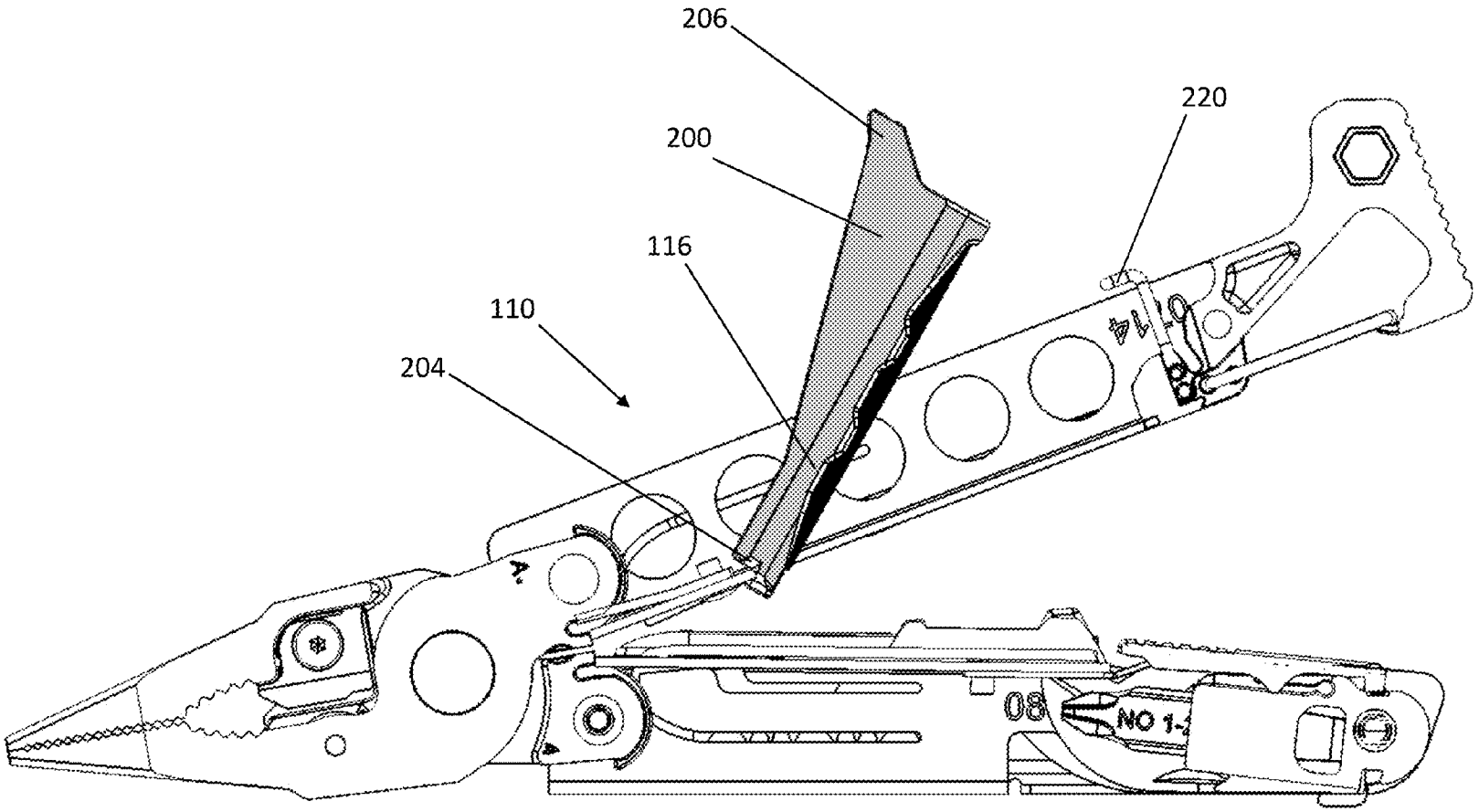
Figure 10:
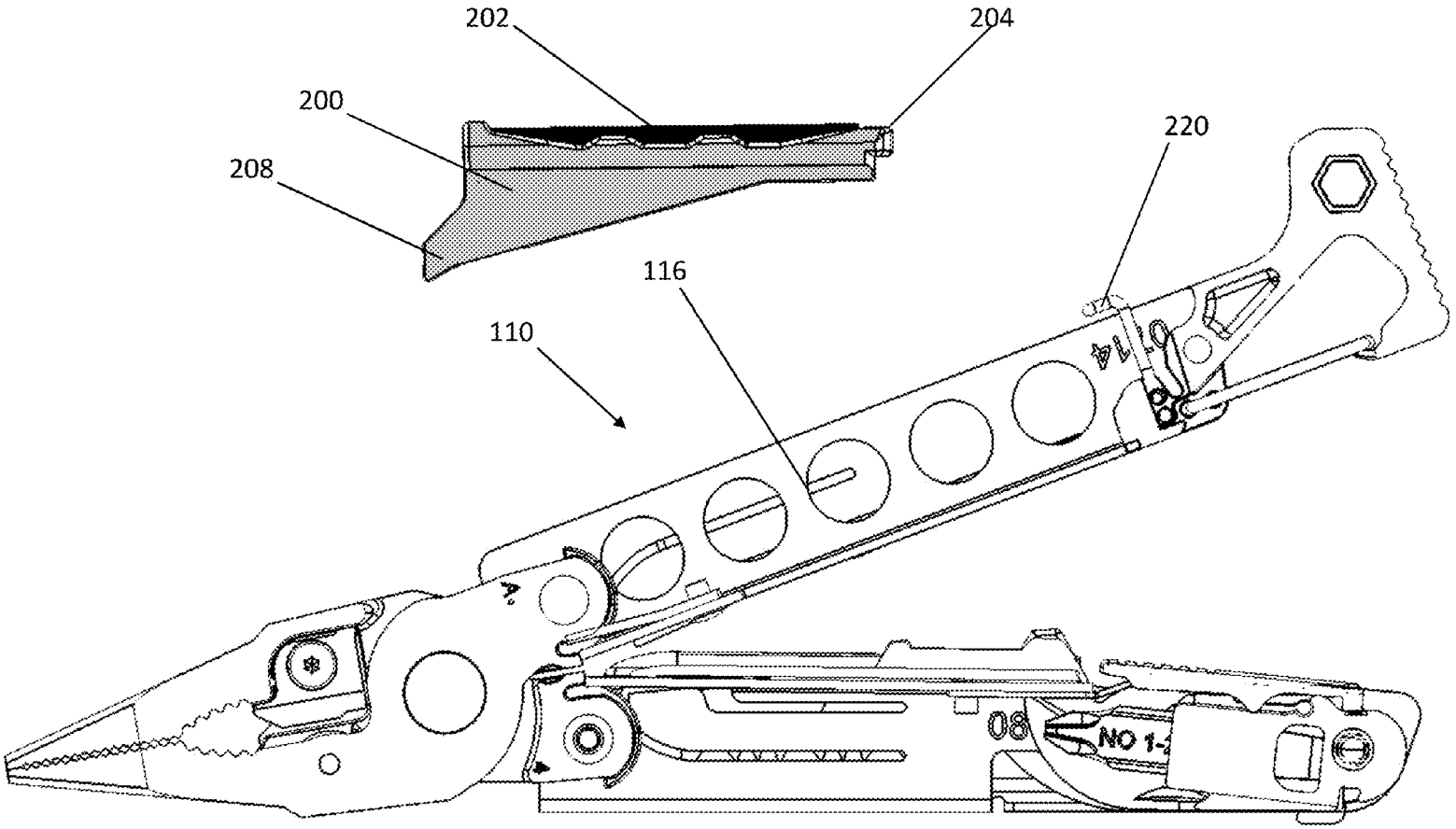
Figure 11:
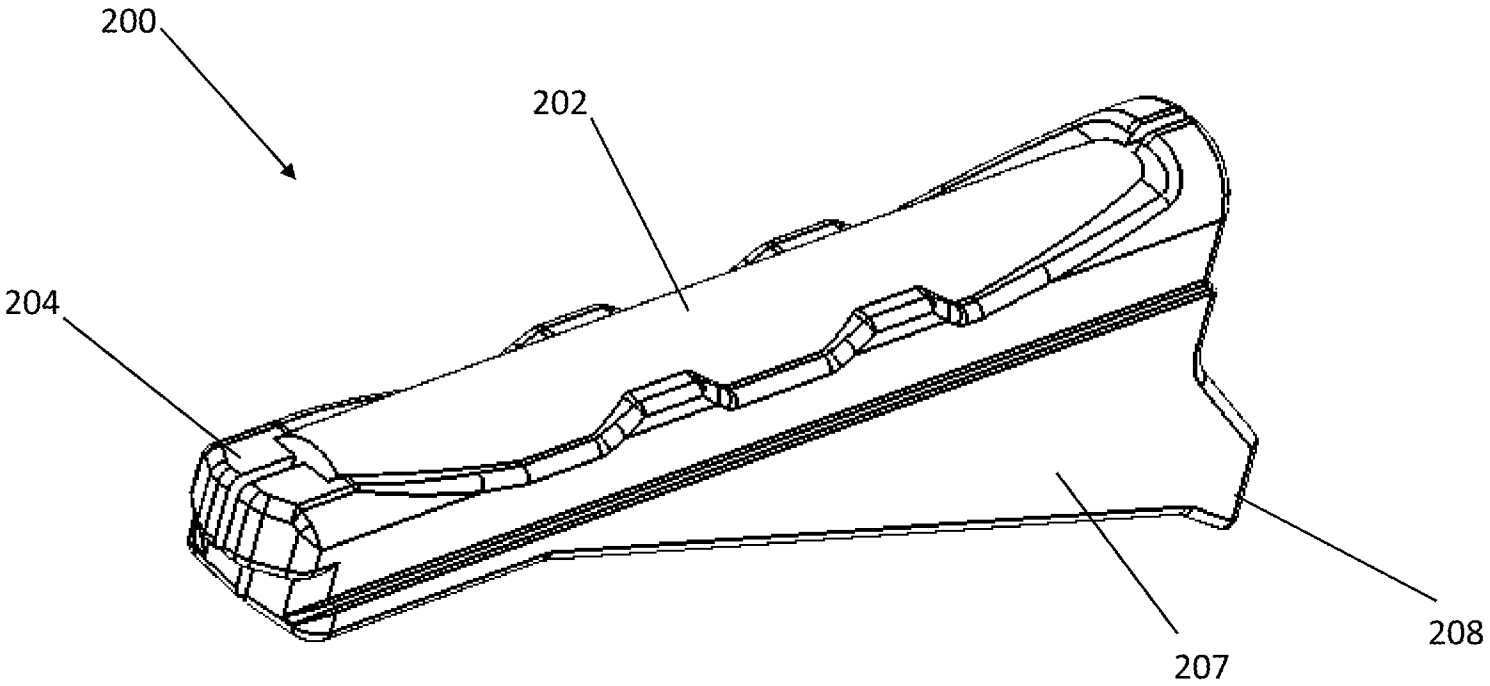
Figure 12:
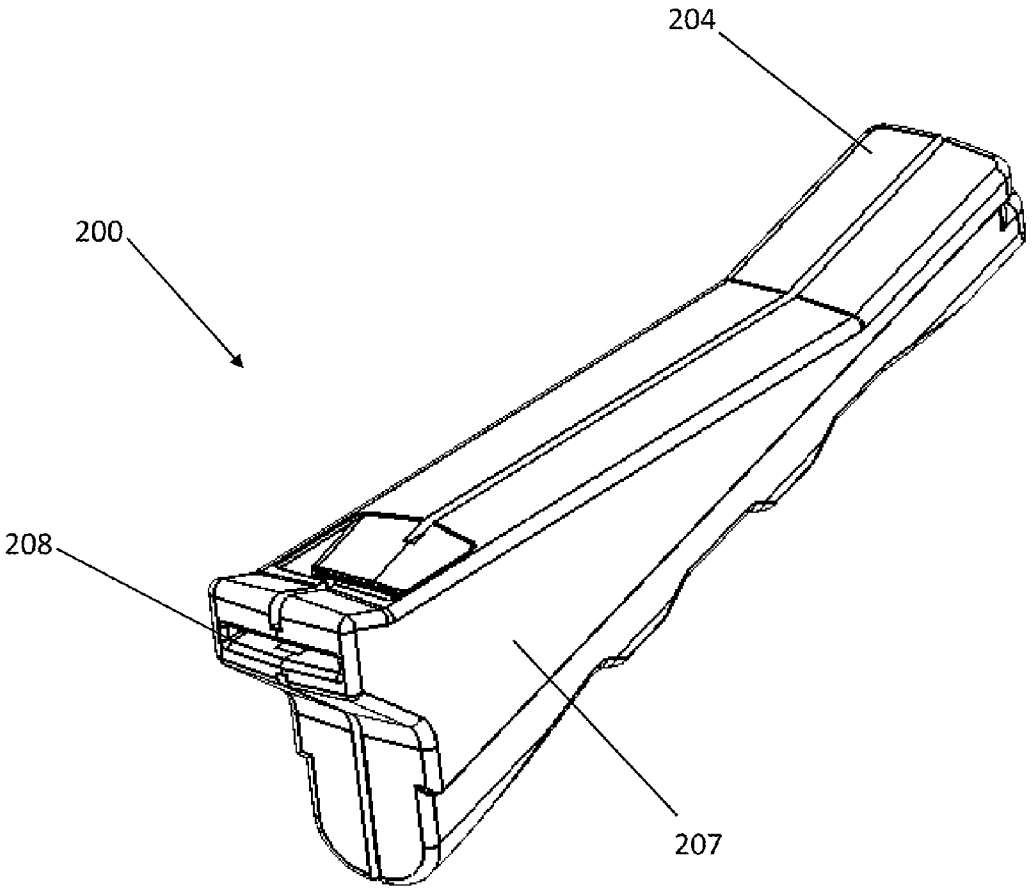
Figure 13:
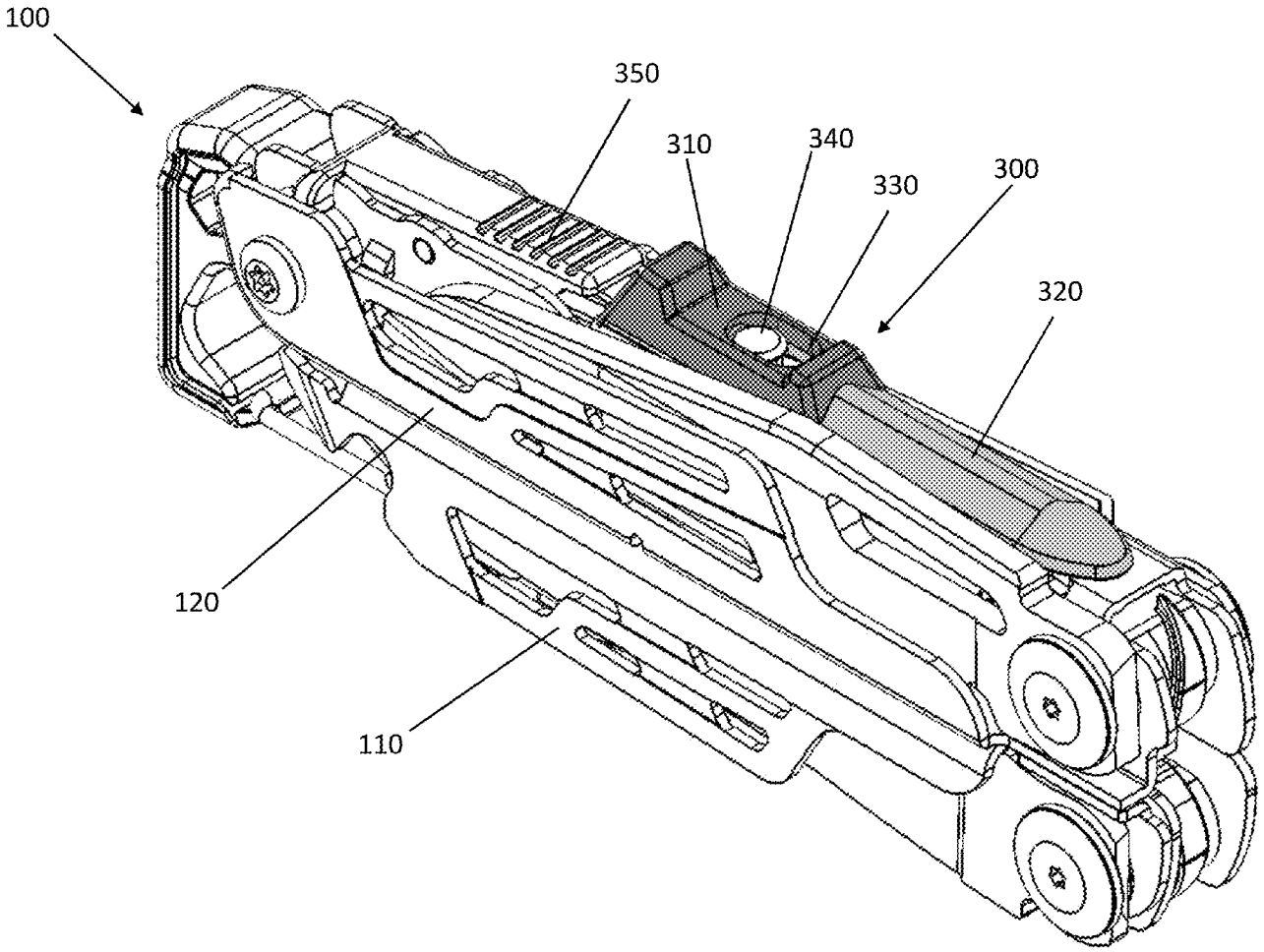
Figure 14:
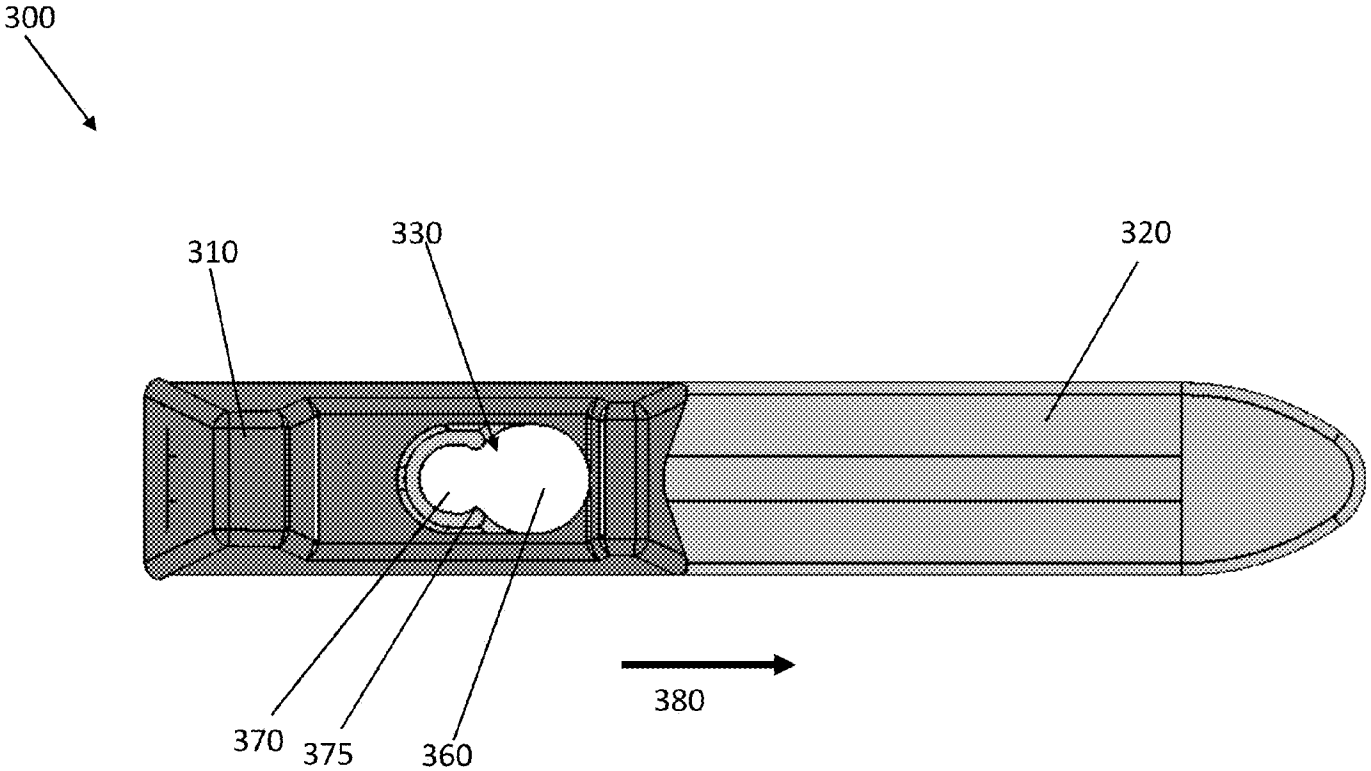
Figure 15:
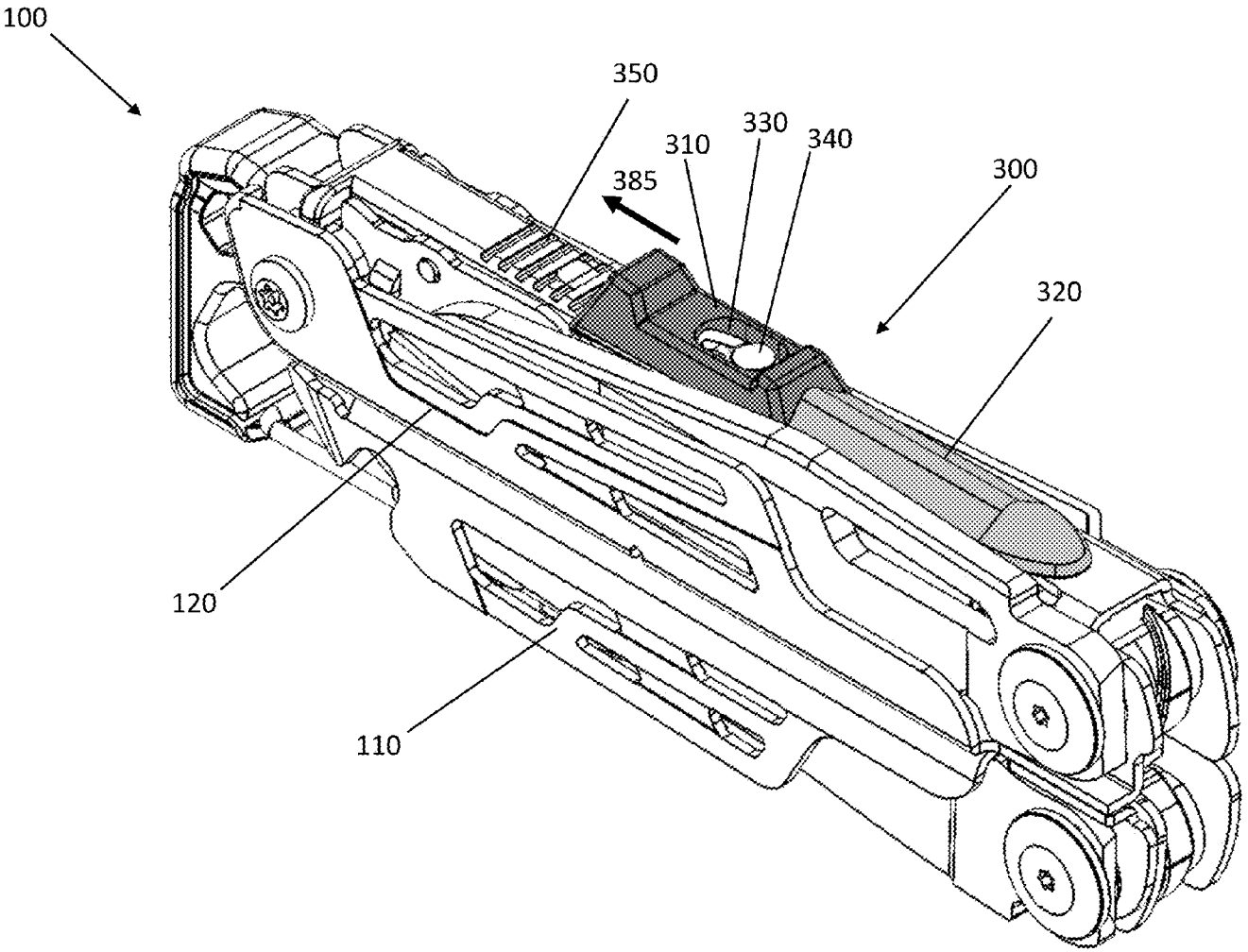
Figure 16:
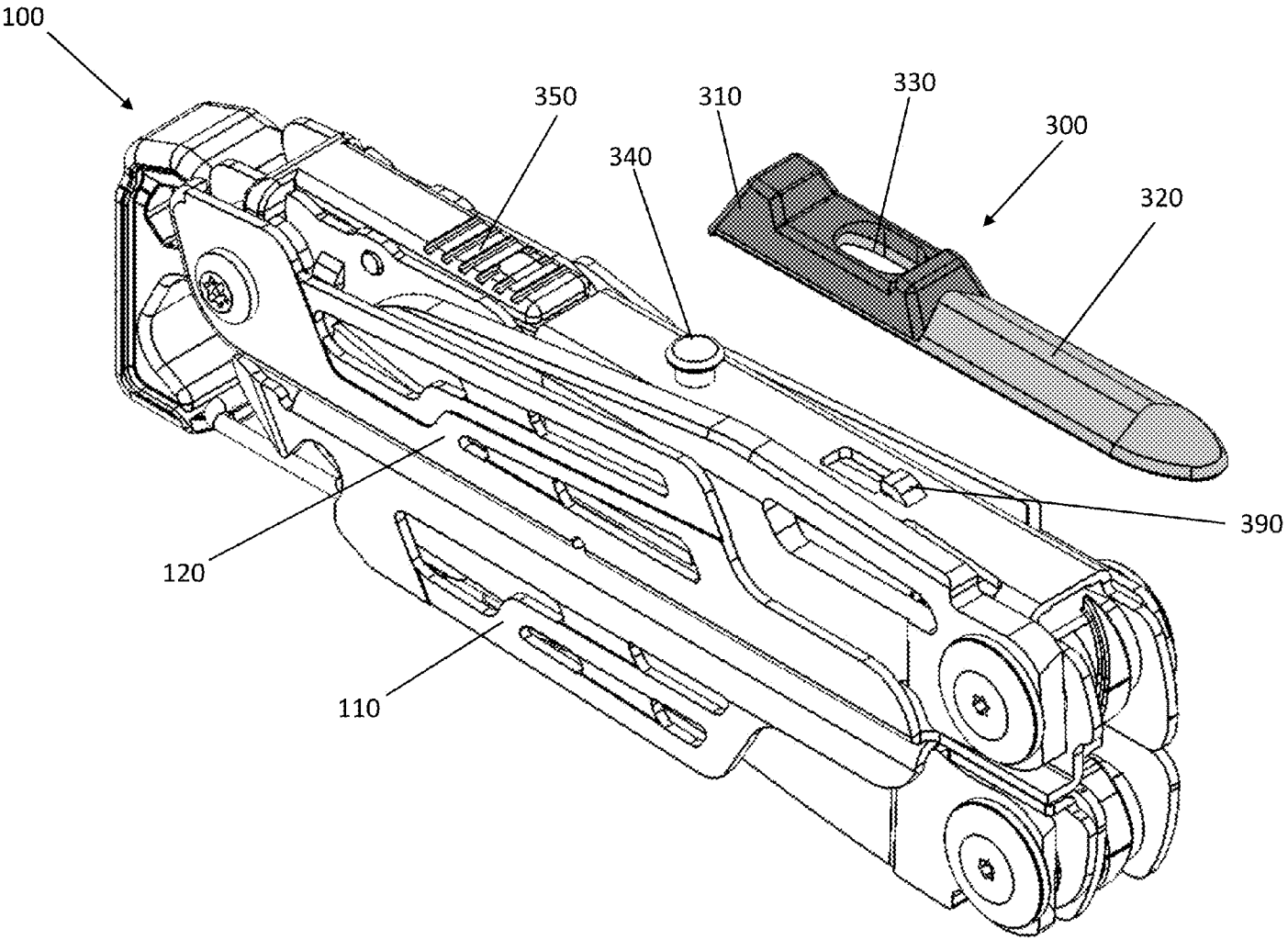
Figure 17:
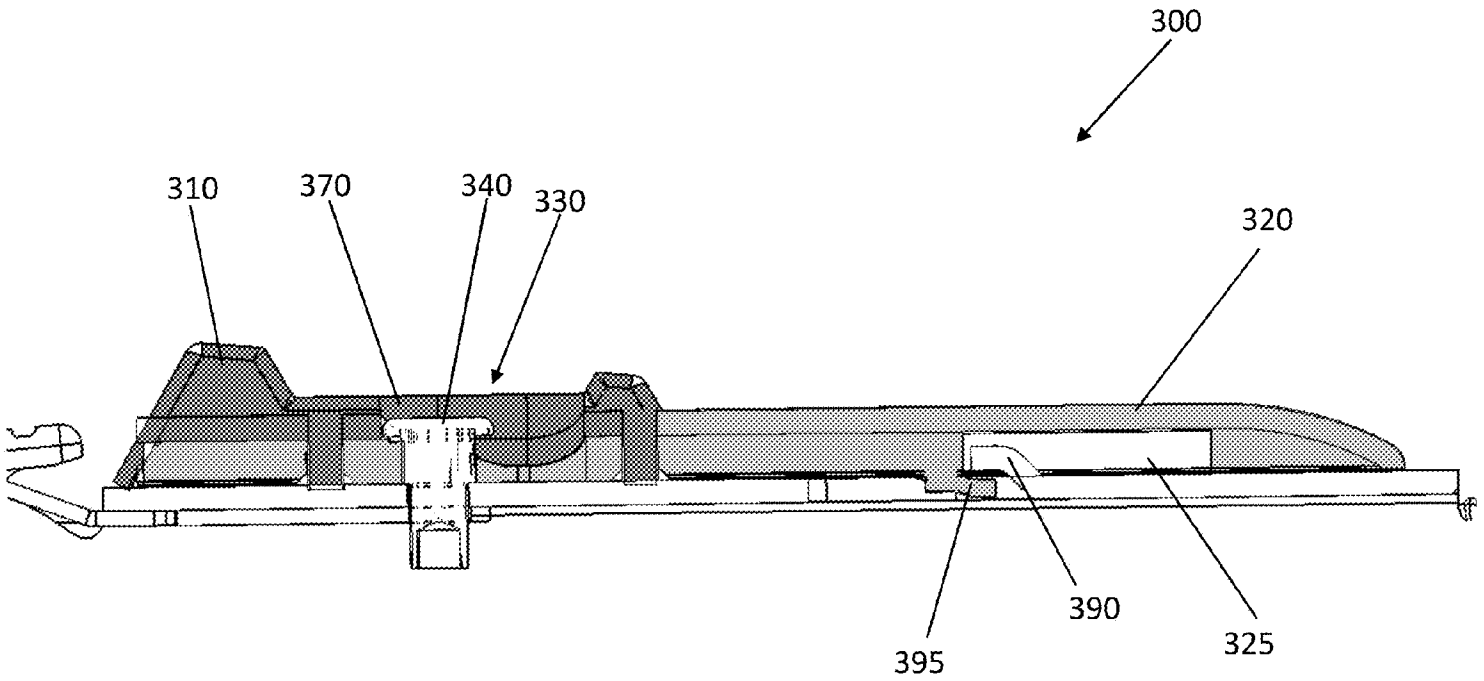

Having thus described the invention in general terms, reference will now be made to the accompanying drawings, which are not necessarily drawn to scale, and wherein:

FIG. 1 illustrates a multipurpose tool in an open position including a removable component according to an example embodiment of the present invention;

FIG. 2 illustrates a multipurpose tool in a closed position including a removable component according to an example embodiment of the present invention;

FIG. 3 illustrates a multipurpose tool in a closed position with a knife blade in an open, deployed position according to an example embodiment of the present invention;

FIG. 4 illustrates a multipurpose tool in a closed position with a saw blade in an open, deployed position according to an example embodiment of the present invention;

FIG. 5 depicts a multipurpose tool in an open position with a plurality of tools in an open or partially open position according to an example embodiment of the present invention;

FIG. 6 illustrates a cross-section view of a multipurpose tool in an open position and including a removable component according to an example embodiment of the present invention;

FIG. 7 illustrates the cross-section view of the multipurpose tool of FIG. 6 with a retention element disposed in a release position and the removable component in a partially removed position according to an example embodiment of the present invention;

FIG. 8 illustrates the cross-section view of the multipurpose tool of FIG. 6 with a retention element disposed in a release position and the removable component in another partially removed position according to an example embodiment of the present invention;

FIG. 9 illustrates the cross-section view of the multipurpose tool of FIG. 6 with a retention element disposed in a capture position and the removable component in still another partially removed position according to an example embodiment of the present invention;

FIG. 10 illustrates the cross-section view of the multipurpose tool of FIG. 6 with a retention element disposed in a capture position and the removable component in a fully removed position according to an example embodiment of the present invention;

FIG. 11 depicts a perspective view of the removable component of the multipurpose tool of FIGS. 6-10 according to an example embodiment of the present invention;

FIG. 12 depicts another perspective view of the removable component of the multipurpose tool of FIGS. 6-10 according to an example embodiment of the present invention;

FIG. 13 illustrates a multipurpose tool in a closed position with a second removable component attached thereto according to an example embodiment of the present invention;

FIG. 14 illustrates the second removable component of FIG. 13 as removed from the multipurpose tool of FIG. 13 according to an example embodiment of the present invention;

FIG. 15 illustrates the multipurpose tool of FIG. 13 in a closed position with the second removable component attached thereto and moved to a release position according to an example embodiment of the present invention;

FIG. 16 illustrates the multipurpose tool of FIG. 13 in a closed position with the second removable component removed from the tool according to an example embodiment of the present invention; and FIG. 17 illustrates a partial cross-section view of the second removable component as attached to the multipurpose tool of FIG. 13 according to an example embodiment of the present invention.

DETAILED DESCRIPTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Referring now to FIG. 1, a multipurpose tool 100 according to one embodiment of the present invention is depicted. The illustrated multipurpose tool includes a first handle 110 and a second handle 120 configured for movement relative to one another, as well a plurality of tools carried by at least one of the handles. The multipurpose tool of example embodiments includes a pair of generally elongate handles that extend between opposed ends 112, 114 and 122, 124, respectively. As a result of their connection, such as a pivotal connection, to one another and/or to one or more of the tools, the handles can be moved toward and away from one another, such as in order to actuate a tool as described below.

As also described below, the multipurpose tool 100 may be configured such that the handles 110, 120 are adapted for relative movement between an open position as shown in FIG. 1 and a closed position as shown in FIG. 2 and discussed hereinafter. As will be apparent, the multipurpose tool 100 has a compact form factor in the closed position so as to facilitate transport and storage of the multipurpose tool. While the multipurpose tool 100 is more expansive in the open position, one or more of the tools of the multipurpose tool are accessible and capable of being utilized in the open position, even though those same tool(s) are stowed and generally inaccessible in the closed position.

With reference to FIG. 1, the multipurpose tool 100 of the illustrated example embodiment includes first handle 110 that is attached at end 112 to a first jaw 130 of a pair of pliers. The tool 100 further includes a second handle 120 that is attached at end 122 to a second jaw 140 of the pair of pliers. In the illustrated position in which the first handle 110 and the second handle 120 are in an open position relative to one another, movement of the handles away from each other open the jaws of the pliers, while movement of the handles toward one another serves to close the jaws of the pliers. The plier jaws are hinged relative to one another at joint 144, which also provides the pivot point for the first handle 110 and the second handle to move toward and away from one another. The plier jaws 130, 140 may include any conventional type of pliers, such as needle nose, flat jaw, round nose, side-cutter, duck bill, parrot-nose, end cutting, etc.; however, the illustrated embodiment includes combination needle-nose pliers and conventional pliers. The illustrated plier jaws further include a wire-cutting nip defined between wire-cutting blades 132, 142. According to some embodiments, the wire-cutting blades 132, 142, may be removable and/or replaceable.

As illustrated in FIG. 1, the multipurpose tool 100 may also include a carabiner 160 for permitting the multipurpose tool to be removably secured to another object, such as a belt loop, key ring, or the like. The carabiner 160 is configured to move in concert with one of the handles 110 and is typically formed by the respective handle, such as at the second end 114 of the first handle 110. The carabiner of the illustrated embodiment is formed of a solid piece of material, such as lightweight alloy or composite. The carabiner 160 defines an opening into an engagement aperture 166 with the engagement aperture being accessible from either side of the carabiner body. In this regard, the object to which the multipurpose tool 100 is desirably attached may be inserted through the opening into the engagement aperture 166 such that the carabiner 160 is effectively clipped to the object. In order to secure the object within the engagement aperture 166, the carabiner 160 can also include a gate 162 that extends across the opening defined by the carabiner. While the carabiner 160 can include a variety of gates, the illustrated embodiment includes a gate 162 that is pivotally connected at one end to the handle 110, as shown. In this regard, the gate 162 may be spring loaded so as to close the opening in the absence of any applied force. Although the gate 162 can be pivotally connected to the handle 110 in various manners, the gate of the illustrated embodiment is a rectangular hoop that is pivotally connected at a first end to a first pivot point and at a second end to a second pivot point, both proximate point 168 of the handle 110. The offset pivot points, combined with the resilient material of the gate 162, combine to bias the gate 162 in the closed position illustrated in FIG. 1.

The carabiner 160 may also include components that provide multipurpose functionality. For example, the front portion 164 of the carabiner 160 may function as a bottle opener when a bottle top is inserted through the gate 162 and the front portion 164 of the carabiner is positioned under the bottle cap. The carabiner 160 may be pivoted relative to the bottle cap to pry the bottle cap from the bottle. Further, a substantially flat surface of the second end 114 of the first handle 110 may also function as a hammer, benefiting from the solid piece of material forming the carabiner 160.

Embodiments may further include a hexagonal recess 170 in the second end 114 of the first handle for use as a wrench. While the illustrated embodiment includes a hexagonal recess, the recess may be of any conventional fastener shape, such as to receive a Torx® head fastener, a 12-point cap screw, etc. Further, the opposite side of the illustrated recess 170 may be of a different size or type of recess. For example, the illustrated side of the second end 114 may include a six-millimeter hex socket while the opposing side may include a four-millimeter hex socket.

The depicted embodiment of FIG. 1 further includes a pocket clip 150 which may be used to secure the multipurpose tool 100 to a pocket, belt, or other piece of material. The pocket clip 150 may be removable to enable the multipurpose tool 100 to have fewer "snag points" if the tool is to be generally carried within a pocket, enabling smoother insertion/removal.

FIG. 3 illustrates an example embodiment of a tool that may be incorporated into the multipurpose tool 100. The depicted tool includes a knife blade 180 that is pivotably attached to the second handle 120 at a pivot point proximate end 122. The knife blade 180 may be pivoted from a closed position shown in FIG. 2 to the open position of FIG. 3. The knife blade 180 may include serrated and unserrated portions as illustrated, or the knife blade may be entirely serrated or unserrated, in dependence of the intended use of the multipurpose tool 100. Once the knife blade 180 is opened to the open position of FIG. 3, a rotation lock 182 may be automatically engaged to preclude the knife blade 180 from folding back to the closed position. The rotation lock 182 may be biased toward the locked position such that as the knife blade 180 is rotated to the open position, the rotation lock is biased into the locked position. In order to close the knife blade 180, a user may press on the rotation lock 182 toward the body of the multipurpose tool, against the bias, and move the knife blade 180 from the open position toward the closed position. When not in the fully open position of FIG. 3, the knife blade 180 may hold the rotation lock 182 against the bias enabling the knife blade to freely move to the closed position, and from the closed position to the open position whereupon the rotation lock 182 will engage and lock the blade in the open position.

FIG. 4 illustrates another tool that may be incorporated into a multipurpose tool 100 of example embodiments. The depicted tool includes a saw blade 190 configured to rotate from the closed position of FIG. 2 to the open position illustrated in FIG. 4. The saw blade 190 may open in a similar manner as the knife blade of FIG. 3 in that the saw blade 190 may pivot about a pivot point proximate the end 112 of the first handle 110. The saw blade 190 may also include a rotation lock 192 that functions in the same manner as the rotation lock 182 of the knife blade 180 to retain the saw blade 190 in the open position for safer use.

FIG. 5 illustrates several other tools that may be incorporated into a multipurpose tool according to example embodiments of the present invention. The depicted tools include an awl or punch 194, a can/bottle opener 196, and a bit-holder tool 198. The can/bottle opener 196 may further include a blade 197 that can be used to slice through material such as a nylon webbing or other resilient material. The bit-holder tool 198 may include a bit, such as the illustrated Philips screw-driver bit 199. The bit 199 may be chosen from a variety of bit types, including a flat-head screwdriver, Torx driver, Allen key, etc. Further the bit 199 may be removable/reversible, with both ends of the bit providing functionality, possibly in the form of differing bit types. The tools 194, 196, 198, shown in FIG. 5 may be accessible when the multipurpose tool 100 is in the open position or partially open position; however, the tools may be used when the multipurpose tool 100 is in any position between the fully-closed position of FIG. 2 and the fully-open position of FIG. 1. One or more of tools 194, 196, or 198, while in the deployed position, may preclude the multipurpose tool 100 from fully closing. In such an embodiment, the tools 194, 196, and 198, may be used while the tool is in any position between the fully-open position and the substantially-closed position. Thus, a user may move any of the tools from the stowed position to the open, deployed position when the multipurpose tool 100 is in the open or a partially-open position, and the user may close or substantially close the multipurpose tool once the selected tool is in the deployed position in order to use the tool.

While the aforementioned tool components of multipurpose tools of example embodiments can be independently used as tools for accomplishing various tasks, other tools may require two separate components to properly function. For example, a sharpening tool, as will be detailed further below, may not be capable of sharpening a knife blade of the multipurpose tool if the sharpening tool and the knife blade are both affixed to the multipurpose tool. As such, example embodiments of the present invention may include removable components that can be used in conjunction with other tools of the multipurpose tool to enhance the functionality of the multipurpose tool.

The illustrated embodiment of FIG. 1 illustrates two removable components 200 and 210. The illustrated removable components include a sharpening tool 210 and a fire-starting tool 200. The removable components 200, 210, may be attached by similar or dissimilar means based upon the type of removable component. Further, the removable components may be securely and uniquely attached to the multipurpose tool of example embodiments to ensure the removable components are not lost or damaged through conventional use of the tool.

FIG. 6 illustrates a section view of the first handle 110 of the multipurpose tool of FIG. 1 depicting the first removable component 200 disposed within a cavity formed by the first handle 110. The section view is taken along line 6-6 illustrated in the top-view of the multipurpose tool shown in FIG. 6. While the removable component is disposed substantially within the cavity 116, a portion of the illustrated removable component 200 is exposed outside of the first handle 110. The exposed portion of the first removable component 110 may include a fire-starting element 202 that may be used to generate a spark or flame when struck by an object, such as the metal blade of a knife. The fire-starting element may be material such as a magnesium rod, fire steel, ferrocerium, or the like. While described as a "fire-starting" element, the element may produce sparks or embers when struck such that the element facilitates starting a fire. The element itself may not necessarily start a fire absent some flammable material to ignite. The fire-starting element 202 may be used while the first removable component 200 is stowed within the cavity 116 of the first handle 110. However, a user of the multipurpose tool 100 may find that they do not have a complementary tool or object to use to strike against the fire-starting element 202 to generate the sparks for starting a fire. In such a situation, the first removable element 200 may be removed from the cavity 116 of the first handle 110 in order to use other tools of the multipurpose tool to strike against the fire-starting element 202. Thus, the first removable component is usable both when attached to the multipurpose tool 100 and when removed from the multipurpose tool, as will be evident from the below description.

The first removable component 200 may be retained within the cavity 116 of the first handle 110 by a retention element 220. The retention element 220 may be configured to hold the first removable component 200 within the cavity by engaging a first end 206 of the first removable component 200. A second end 204 of the first removable component 200 may be engaged with an aperture within the first handle such that the retention element 220 securely holds the first removable component in place. According to the illustrated embodiment, in order to remove the first removable component 200 from the cavity 116 of the first handle 110, the retention element 220 may be moved from the capture position illustrated in FIG. 6 to a release position, in the direction of arrow 222. The retention element 220 may be biased toward the capture position of FIG. 6 such that a force must be applied in the direction of arrow 222 in order to overcome the bias and move the retention element 220 to the release position. The bias of the retention element may be beneficial to preclude the first removable component 200 from accidentally being removed or falling out of the cavity 116.

While the illustrated embodiment depicts a pawl-type retention element 220, various other embodiments of retention elements can be implemented in other example embodiments. For example, a spring-biased ball retained within the tool or the removable component could engage a detent in the other of the tool or the removable component. Another retention element could include a deformable member that engages a pin or ridge such that the deformable member is deformed to advance the removable component from the capture position to the release position. Still further, the retention element could include a magnet to retain the removable component from the cavity. As is to be understood to one of ordinary skill in the art, the retention element may be embodied by various example embodiments.

FIGS. 6-9 illustrate the removal of the first removable component 200 from the cavity 116 of the first handle 110. Once the retention element 220 is moved to the release position of FIG. 7, the first removable component 200 may move past the retention element 220, while pivoting from the second end 204. The multipurpose tool may be held in such a way that gravity assists in moving the first removable component 200 past the retention element 220, and optionally, a user may press on the portion of the first removable component 200 that is exposed outside of the first handle of the multipurpose tool to move the first removable component past the retention element. FIG. 8 illustrates the first removable element moving further from the cavity 116 of the first handle 110. FIG. 9 illustrates the first removable component 200 mostly removed from the cavity 116, with the first end 204 of the component pivoting from the aperture in the first handle 110 while the retention element 220 is released and is biased back toward the capture position. From the position of FIG. 9, the first removable component 200 may be fully removed from the cavity 116.

FIG. 10 depicts the first removable component 200 removed from the multipurpose tool, while FIGS. 11 and 12 illustrate the first removable component 200 in perspective views. The first removable component 200 may include a body 207 that enables a user to hold the first removable component 200 while using the fire-starting element 202. The body 207 may be made from various materials, but is preferably a light-weight material that is sufficiently rigid to be used to hold the fire-starting element 202 while it is struck with another object. According to the illustrated embodiment, the body 207 is formed of two plastic halves that may be ultrasonically welded together to form the body. Further, the body 200 of the illustrated embodiment includes a whistle 208 integrally formed therein. The whistle may generate a high-pitch audible tone in response to a user blowing into the mouthpiece shown as 208 in FIG. 12. The frequency of the audible tone may be any frequency capable of being produced with the size limitations defined by the cavity 116 of the handle 110; however, a frequency in the range of 1,000 Hz to 3,500 Hz may be desirable as this range is where human hearing is most sensitive. Frequencies around 3,000 Hz to 3,500 Hz may be particularly desirable with these frequencies being similar to the range of frequencies generated by residential smoke detectors.

Another example embodiment of a tool that may benefit from being removable from a multipurpose tool according to the present invention may include a sharpening tool configured to be used to sharpen one or more of the various tools of the multipurpose tool 100. FIG. 13 illustrates an example embodiment of a second removable component 300 of a multipurpose tool according to example embodiments of the present invention. While described herein as a second removable component, either the first or the second removable component can be used independently of the other such that the second removable component or the first removable component could be the only removable component of some example embodiments. The term "second" is used herein merely to distinguish the removable components. The second removable component 300 may include a handle portion 310 and a sharpening portion 320. The second removable component 300 may include a keyway 330 defined therein configured to receive a stepped rivet 340 for securing the second removable component 300 to the multipurpose tool 100.

FIG. 14 illustrates the second removable component 300 removed from the multipurpose tool 100, depicting the keyway 330. The keyway, as illustrated, may include a first portion that is sized to receive therein the rivet 340. When the rivet 340 is aligned with the first portion 360 of the keyway 330, the second removable component 300 may be lifted off of the multipurpose tool 100 as the head of the rivet 340 may pass through the first portion 360 of the keyway 330. When the rivet is received within the first portion 360 of the keyway 330, a user may press the second removable component 300 in the direction of arrow 380 relative to the multipurpose tool 100 to drive the rivet 340 from the first portion 360 of the keyway 330 to the second portion 370 of the keyway. The second portion 370 of the keyway 330 may be sized such that the second removable component 300 may not be lifted from the rivet 340 (e.g., the slot may be smaller than the head of the rivet). Further, a neck portion 375 may exist between the first portion 360 of the keyway and the second portion 370 of the keyway, where the neck portion is sized to be smaller than the diameter of the rivet shaft in order to require a threshold amount of force to be applied to the second removable component 300 to move the second removable component relative to the rivet. For example, when the rivet 340 is received within the second portion 370 of the keyway 330, a user may need to press the second removable component with a threshold amount of force in the direction opposite that of arrow 380 in order to position the rivet 340 in the first portion 360 of the keyway 330. At that point, the user may remove the second removable component 300 from the multipurpose tool. This configuration enables the second removable component to be securely held by the multipurpose tool and to avoid accidental removal of the second removable component.

Referring back to FIG. 13, the multipurpose tool may include a lock release lever 350 that may be configured to hold one or more tools of the multipurpose tool in an extended position. For example, the tools 194, 196, and 198, may be held in the open, deployed position by a lock mechanism. A force applied to the lock release lever 350 may release the lock and enable the tools 194, 196, 198, to be moved to the closed position. This lock release lever 350 may also function to preclude accidental removal of the second removable component 300 from the multipurpose tool 100. As visible in the view of FIG. 4, the second removable component 300 may be inhibited from movement in the direction of arrow 385 when the lock release lever 350 is in the illustrated locked position. As the lock release lever 350 may be biased in the locked position, a user may need to apply a force to the lock release lever 350 against the bias in order to move the lock release lever 350 from the path of the second removable component 300. When the lock release lever 350 is depressed, the second removable component 300 may be moved in the direction of arrow 385 in order to align the rivet 340 with the first portion 360 of the keyway 330 illustrated in FIG. 14.

FIG. 15 illustrates the second removable component moved in the direction of arrow 385 to place the second removable component 300 in a release position. In this position, a user may lift the second removable component 300 from the multipurpose tool 100. FIG. 16 illustrates the second removable component 300 removed from the multipurpose tool 100. FIG. 16 also depicts an alignment feature 390 of the multipurpose tool 100 that is configured to engage a recess within the second removable component 300 to align the second removable component and to preclude the second removable component 300 from rotating on the rivet 340 when the second removable component is attached thereto. FIG. 17 illustrates a cross-section view of the second removable component 300 as attached to the multipurpose tool 100. As shown, the rivet 340 is received in the second portion 370 of the keyway 330. The second removable component 300 may further include a cavity 325 disposed therein configured to receive the alignment feature 390. The alignment feature may include a hook-shape as illustrated, and the second removable component 300 may include an engagement feature 395 configured to complement and engage the alignment feature 390 of the multipurpose tool. While the engagement feature is not necessary to preclude rotation of the second removable component about the rivet 340, the engagement feature 395, when engaged with the alignment feature 390, may function to preclude the second removable feature from lifting away from the body of the multipurpose tool. Such a feature may be beneficial to preclude the second removable feature from being snagged and lifted away from the tool inadvertently.

The removable components described herein are directed to tools that can be used in conjunction with other features of the multipurpose tool. However, other removable components may be used with multipurpose tools of example embodiments in dependence of the desired use of the multipurpose tool. For example, a removable component may include a vial configured to hold therein water purifying tablets or medication. Removable components may optionally include a laser pointer or flashlight, a writing implement, a tool bit, or the like. Removable components may be of various types and sizes, but may include the attachment means described herein to secure the removable components to the multipurpose tool.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A multipurpose tool comprising:

a first handle and a second handle configured for relative movement between a closed position and an open position, wherein the first handle defines a cavity that is accessible in response to the first handle and second handle being disposed in the open position relative to one another, and inaccessible in response to the first handle and second handle being disposed in the closed position relative to one another;

a removable component disposed within the cavity of the first handle, wherein the removable component is accessible in response to the first handle and the second handle being disposed in the open position relative to one another; and a retention element disposed within the cavity configured for relative movement within the cavity between a capture position and a release position, wherein the retention element is biased in the capture position;

wherein the retention element is configured to retain the removable component within the cavity in response to the retention element being disposed in the capture position, wherein the removable component is removable from the cavity in response to the retention element being moved to the release position, and wherein the removable component is configured to drive the retention element from the capture position to the release position in response to the removable element being inserted into the cavity toward the capture position.

2. The multipurpose tool of claim 1, wherein the retention element is configured to return to the capture position in response to the removable element being seated in the capture position within the cavity.

3. The multipurpose tool of claim 1, wherein the removable component comprises a fire-starting element.

4. The multipurpose tool of claim 3, wherein the removable component further comprises a whistle.

5. The multipurpose tool of claim 1, further comprising a first jaw of a pair of pliers attached to the first handle and a second jaw of the pair of pliers attached to the second handle, wherein the first jaw is hingedly attached to the second jaw, wherein the first jaw and the second jaw of the pair of pliers are disposed in a deployed position in response to the first handle and the second handle being disposed in the open position relative to one another, and wherein the first jaw and the second jaw of the pair of pliers are disposed in a stowed position in response to the first handle and the second handle being disposed in the closed position relative to one another.

6. The multipurpose tool of claim 5, wherein the first jaw is configured to be received in a cavity within the second handle and the second jaw is configured to be received in the cavity within the first handle in response to the first handle and the second handle being disposed in the closed position relative to one another.

7. The multipurpose tool of claim 1, further comprising a second removable component, wherein the second removable component comprises an abrasive surface.

8. The multipurpose tool of claim 7, further comprising a knife blade movable between a stowed position and a deployed position, wherein the knife blade is received within at least one of the first handle and the second handle in response to being disposed in the stowed position, and wherein the abrasive surface of the second removable element comprises a surface configured to sharpen the knife blade.

9. The multipurpose tool of claim 8, wherein the second removable component defines a channel, and wherein at least one of the first handle or the second handle comprises a raised element configured to be received within the channel to secure the second removable component to the at least one of the first handle or the second handle.

10. A multipurpose tool, comprising:

a first handle and a second handle configured for relative movement between a closed position and an open position;

a folding tool movable between a stowed position and a deployed position, wherein the tool is received within the first handle or the second handle in response to being disposed in the stowed position;

a removable component received within the cavity, the removable component comprising a fire-starting element configured for use with the folding tool when the removable component is removed from the cavity; and a retention element disposed within the cavity movable between a capture position and a release position, wherein the retention element is configured to retain the removable component within the cavity in response to the removable component being received within the cavity and the retention element being disposed in the capture position.

11. The multipurpose tool of claim 10, wherein the retention element is biased toward the capture position, and wherein the removable component is configured to drive the retention element from the capture position to the release position in response to the removable component being inserted into the cavity.

12. The multipurpose tool of claim 10, wherein the cavity is accessible in response to the first handle and second handle being disposed in the open position relative to one another, and inaccessible in response to the first handle and second handle being disposed in the closed position relative to one another.

13. The multipurpose tool of claim 10, wherein the removable component is a first removable component, the multipurpose tool further comprising a second removable component, wherein the second removable component comprises an abrasive surface.

14. A multipurpose tool comprising:

a first handle and a second handle configured for relative movement between a closed position and an open position;

a folding tool movable between a stowed position and a deployed position, wherein the tool is received within the first handle or the second handle in response to being disposed in the stowed position; and a removable component removably attached to the first handle, wherein one of the removable component or the first handle comprises a raised rivet, wherein the other of the removable component or the first handle comprises a recess defining a first recess portion and a second recess portion, wherein the rivet is configured to be removably received within the first recess portion and moved, relative to the recess, to the second recess portion, wherein the removable component is secured to the first handle in response to the raised rivet engaging the second recess portion.

15. The multipurpose tool of claim 14, wherein the rivet comprises a shaft portion and a head portion, the recess further comprising a neck portion defined between the first recess portion and the second recess portion, wherein the neck portion of the recess is narrower than a diameter of the shaft portion of the rivet.

16. The multipurpose tool of claim 15, wherein a diameter of the first recess portion is equal to or greater than a diameter of the head portion of the rivet, and wherein a diameter of the second recess portion is smaller than the diameter of the head portion of the rivet.

17. The multipurpose tool of claim 14, wherein one of the first handle and the removable component comprises an alignment feature, wherein the other of the first handle and the removable component comprises a cavity, and wherein the alignment feature is configured to engage the cavity in response to the removable component being attached to the first handle.

18. The multipurpose tool of claim 14, further comprising a lock release lever disposed on the first handle, wherein the lock release lever defines a raised, locked position, and a depressed, release position, wherein the rivet is precluded from being moved from the second recess portion to the first recess portion in response to the lock release lever being in the raised, locked position.

* * * * *